United States Patent [19]

Tucker, deceased et al.

[11] 3,964,197

[45] June 22, 1976

[54] VERSATILE OUTDOOR SIGN

[76] Inventors: Robert F. Tucker, deceased, late of Cassleberry, Fla.; Ruth L. Tucker, executrix, 291 Lake Griffin Circle, Cassleberry, Fla. 32707

[22] Filed: June 24, 1974

[21] Appl. No.: 482,504

[52] U.S. Cl. ..... 40/125 E; 40/130 J; 40/144

[51] Int. Cl.[2] ..... G09F 7/02

[58] Field of Search..... 40/125 E, 125 F, 125 K, 40/125 R, 125 G, 144, 28 C, 130 J

[56] References Cited

UNITED STATES PATENTS

| | | | |
|---|---|---|---|
| 507,952 | 10/1893 | White | 40/125 E |
| 1,052,744 | 2/1913 | Newell | 40/28 C |
| 1,064,897 | 6/1913 | Gabet | 40/125 E |
| 2,902,786 | 9/1959 | Schneider | 40/144 |
| 3,362,093 | 1/1968 | Joselevich | 40/28 C |

FOREIGN PATENTS OR APPLICATIONS

| | | | |
|---|---|---|---|
| 653,259 | 11/1928 | France | 40/125 E |
| 606,822 | 3/1926 | France | 40/125 E |

*Primary Examiner*—Hugh R. Chamblee
*Assistant Examiner*—John F. Pitrelli
*Attorney, Agent, or Firm*—Julian C. Renfro

[57] ABSTRACT

A novel sign usable for advertising or for decorative purposes, involving a mesh defining a large number of regularly recurring apertures, into which a number of colored chips may be easily installed in a pre-established pattern or configuration. By selective installation of the novel chips, letters and therefore words may be rapidly created, without it being necessary to expend the time or the money required in order to create a painted sign, or to utilize preformed letters. The novel chips may also be used for creating ornamental configurations, used alone or in conjunction with displays or symbols used in advertising. In the event the mesh used is in the nature of a chain link fence, having some dimension in the thickness direction, a display may be created on each side of the fence, with one display perhaps being entirely unrelated to the other. Further, a series of elongate members disposed in a parallel array between the chips may be utilized in order to create a pleasing background for the chips used. Advantageously, my novel chips can be inserted in the positions desired without any tools being necessary, but once inserted, they become locked into position, and cannot be removed except as the result of a deliberate effort.

24 Claims, 12 Drawing Figures

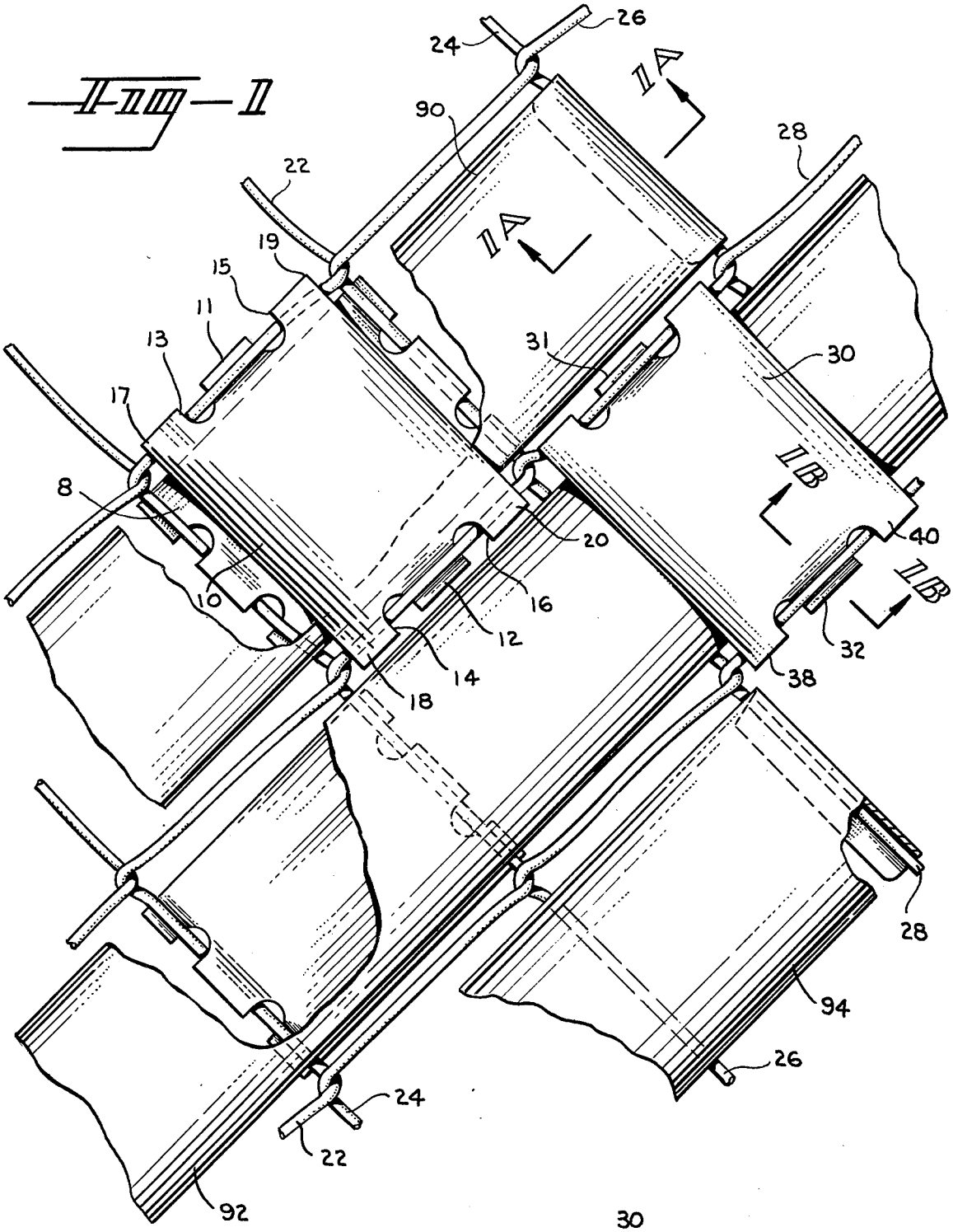
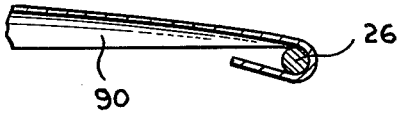
FIG—1A
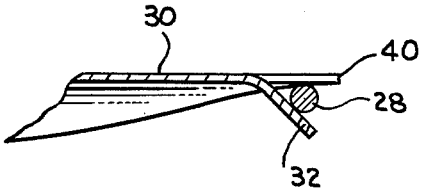
FIG—1B

Fig-3
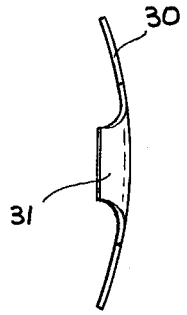
Fig-2
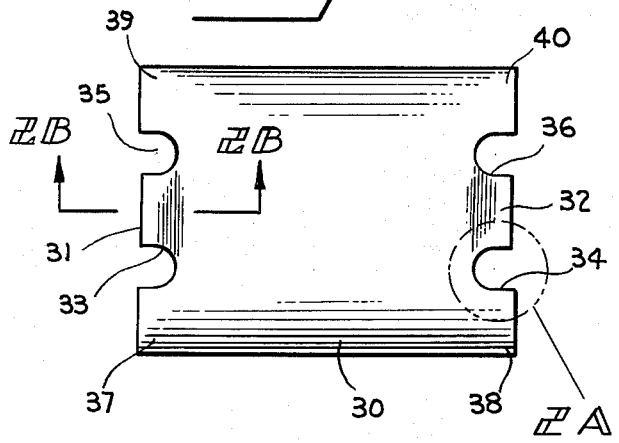
Fig-2A
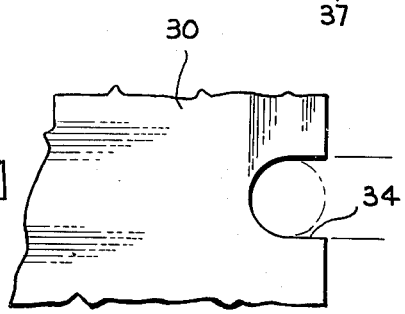
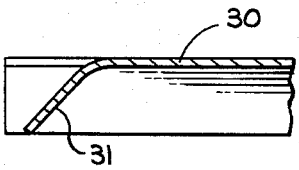
Fig-2B
Fig-4A
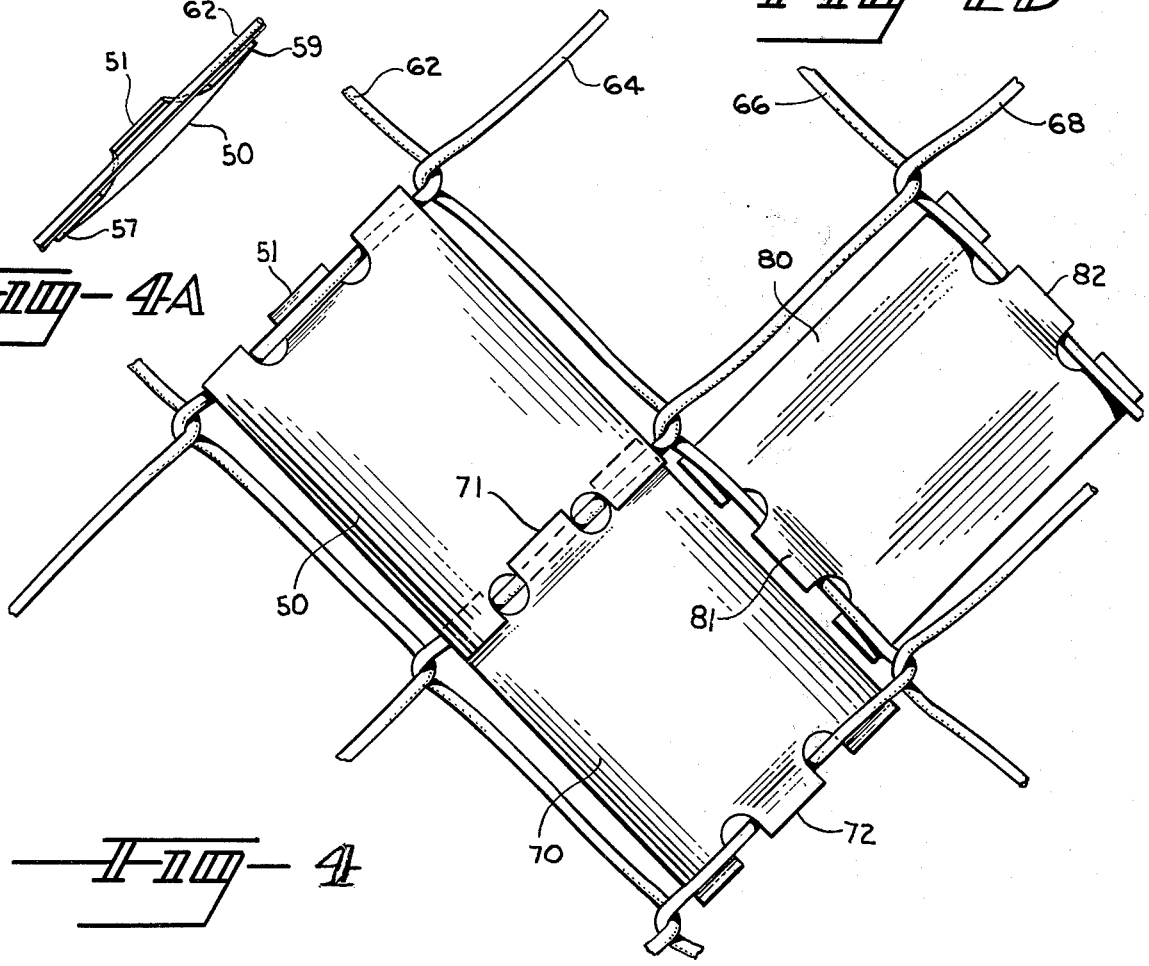
Fig-4

VERSATILE OUTDOOR SIGN

BACKGROUND OF THE INVENTION

In the past, a number of signs have been proposed in which the information being provided can be readily changed. Some signs of course involve the use of preformed letters, which can be fastened or secured in word-forming relationships in a minimum of time. However, in signs of this type, it is usually necessary to have at least four full alphabets of letters on hand, in order to be able to spell out the wide variety of words ordinarily encountered in advertising. Not only does this represent a substantial expense, but also, the volume required for the storage of letters that at a given time are not in use can be quite considerable. Further, the cost associated with the provision of suitable means for receiving the preformed letters and the supporting thereof in the proper relationships can likewise become quite large. Other problems include susceptibility to wind damage, and sometimes large rental fees associated with most conventional signs, in that they usually require a considerable space for their installation, due to their size and the wind loading that must be taken into consideration. It is to overcome disadvantages of this type that my invention was made.

SUMMARY OF THIS INVENTION

An advertising or decorative sign for displaying intelligence in accordance with this invention comprises a mosaic type arrangement, involving a plurality of strands of wire configured so as to define numerous apertures therein of substantially square configuration and of approximately equal size. Installed at selective locations in such apertures are a plurality of novel, self-locking chips, each of approximately the size of such apertures, with these chips being configured for insertion into alternate or adjacent apertures to form a readily created mosaic type of intelligence display.

Each chip of the plurality is constructed to have a pair of oppositely disposed attachment edges adapted to engage opposite sides of a given aperture, with the longitudinal dimension of each chip measured between such oppositely disposed edges being slightly greater than the distance between corresponding sides of the aperture in which the chip is to be installed.

Each of my novel chips is sufficiently flexible as to be able to be bent by finger pressure to an extent that will materially decrease the distance between its opposite edges, such that a chip, when in such bent condition, is able to be inserted in an aperture in the mesh or alternatively, to be removable therefrom. Each chip is also resilient, so that when a chip is released from the bent or compressed condition, it automatically returns to its full length condition. Thus, when a chip is properly installed in an aperture in the mesh, it locks itself in so as not to be removable except as a result of a deliberate effort.

Both metallic as well as nonmetallic materials may be used in chip construction, and when metallic construction is used, each chip preferably possesses curvature in a plane transverse to its length, with the bending of a chip by finger pressure being in a direction such as to decrease the transverse curvature while decreasing the length of the chip. Preferably, the opposite edges intended to contact and interlock with the wire at each end of the respective aperture are provided with tabs arranged to engage the mesh in a particularly advantageous manner, to bring about the locking action that serves to prevent dislodgment. These tabs are to some extent adjustable, so that the chips can be accommodated in apertures of different sizes. As will be discussed hereinafter, I may use any of a number of nonmetallic resilient materials such as rubber, plastic, or the like in chip construction.

As is obvious, I may use chips that possess various colors, thereby making it possible to create signs that are particularly attractive and eye-catching, and also that are visible for long distances. Quite obviously, the sign can be made ever more visible and eye-catching by utilizing fluorescent or reflective coatings.

By the practice of my invention I can readily and rapidly create signs on otherwise unused locations such as fences and the like without damage to same, employing comparatively inexpensive components, rather than much more expensive preformed letters. By not having to store preformed letters, I can accommodate all of the components necessary for the creation of almost any desired sign in a space no larger than a cigar box, whereas to accommodate preformed letters for the same sign would have required a much larger volume. Experience has shown that several alphabets of letters must be carried by persons responsible for creating ordinary signs, whereas, as just indicated, the components I utilize are quite small and of identical construction, with the only variant involving the coating utilized.

It is therefore an object of my invention to provide a highly effective advertising or decorative sign that can be created easily and economically.

It is another object of my invention to provide a low-cost yet highly effective means for creating an eye-catching sign usable in a wide variety of applications.

It is yet another object of my invention to provide an attractive, durable sign made up of a large number of like components that are easily removed from one position and placed in another position as conditions may warrant, yet which resist undesired displacement due to wind and weather.

It is still another object of my invention to provide a versatile and attractive sign made from components storable in a very small volume, thus diminishing markedly the amount of material and apparatus that a sign builder must carry.

It is yet still another object of my invention to provide a particularly versatile sign, made up of a plurality of novel self-locking chips that can be inserted easily and rapidly in a mesh such as a chain link fence so as to create an advertisement, decoration, or other form of intelligence.

It is yet still further object of my invention to create a novel sign having all the advantages of luminous, easily seen letters, without involving the expense, time consumption, or the non-changeable nature of other type signs.

These and other objects, features and advantages of my invention will be more apparent from a study of the enclosed drawings in which:

FIG. 1 is a fragmentary portion of a chain link fence, showing the installation thereof of several novel chips in accordance with this invention, as well as several background strips;

FIG. 1A is a cross-sectional view taken at location 1A —1A on FIG. 1:

FIG. 1B is a cross-sectional view taken at a location 1B —1B on FIG. 1 to reveal the interaction of a typical tab with the side of an aperture;

FIG. 2 is a typical self-locking chip in accordance with the embodiment of this invention involving metallic construction;

FIG. 2A is a fragmentary portion of the chip of FIG. 2, this portion revealing to a large scale, the configuration of a typical notch;

FIG. 2B is a cross-sectional view taken at location 2B — 2B on FIG. 2 to reveal the tab opposite the tab depicted in FIG. 1B;

FIG. 3 is a side elevational view of the chip shown in FIG. 2, illustrating the transverse curvature metallic chips preferably possess;

FIG 4A is an edge view showing how the corners at one end of a typical chip of rectangular configuration are caused to clutch the wire very tightly as a result of the action of the tabs;

FIG. 6 is the reverse side of the sign shown in FIG. 5, illustrating how the information on one side of the sign can be entirely different than the information on the other side.

DETAILED DESCRIPTION

Figure 5:
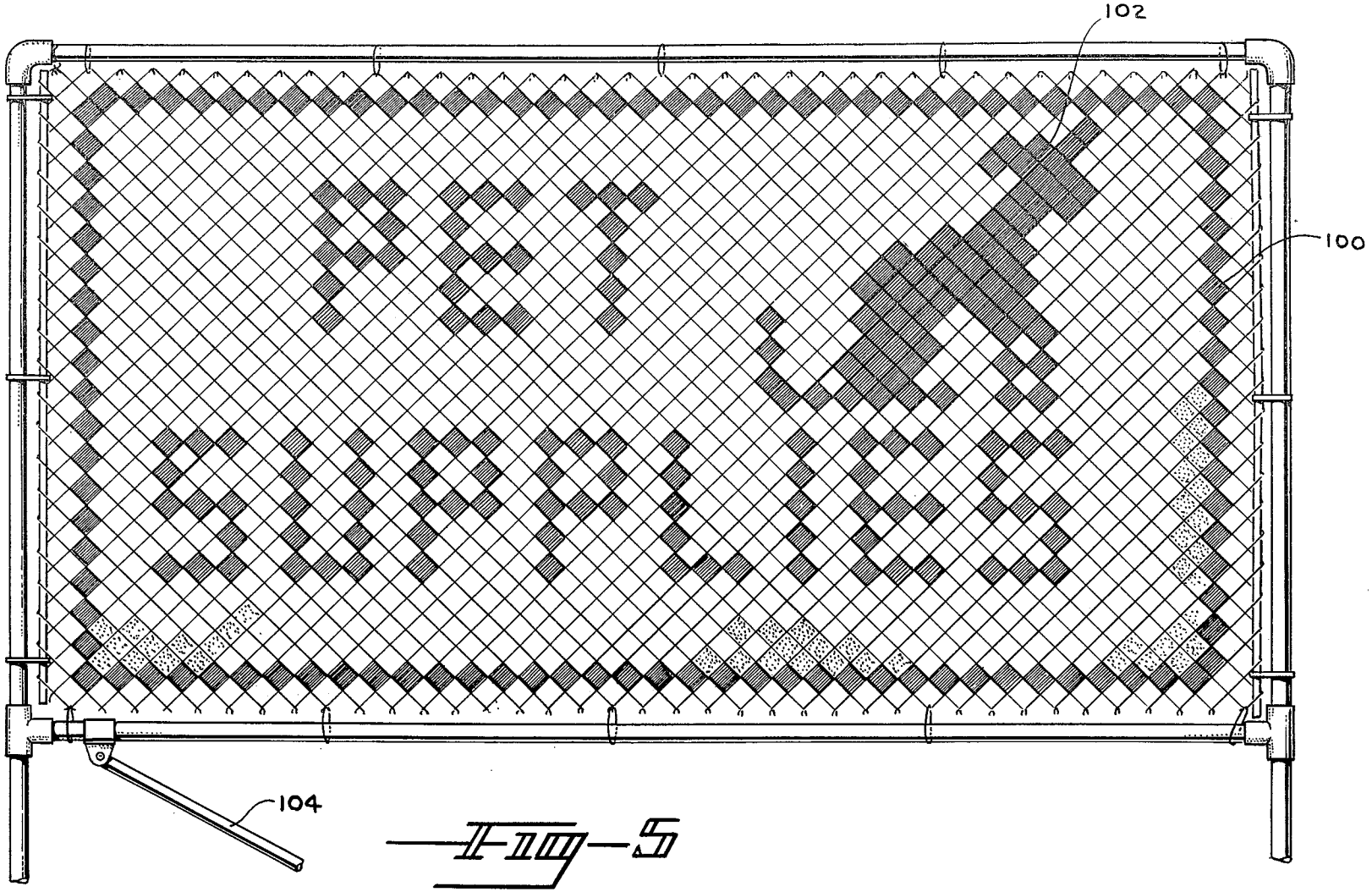
FIG. 5 illustrates an entire section of chain link fence, this section being of a length sufficient to permit the installation of enough chips that an entire advertisement can be created thereon.

Turning to FIG. 1, it will be seen that I have there shown to large scale, typical components employable in accordance with this invention to create an eye-catching sign useful for advertising or decorative purposes. Principally involved are a number of colored chips such as shown at 10 and 30 that can be utilized in a preascertained manner to represent a desired form of intelligence. These novel chips are typically colored, usually of springy or resilient construction, and each has opposite attachment edges specially configured so as to easily yet effectively engage a mesh, such as a chain link fence. Although I mention chain link fences because they are ideal to use in connection with my invention, I am in no way to be limited to using my novel chips with fences, and as a matter of fact, some of the primary uses of my invention to date have involved specially constructed mesh signboards that may be towed behind a vehicle from place to place, and then put on display on a rental basis in highly advantageous locations.

As will be noted from the exemplary embodiment shown in FIG. 1, chip 10 is rectangular and has bent tabs 11 and 12 at its opposite or lengthwise ends, adapted to engage the strands of wire disposed in the ends of the aperture in the fence or other mesh in which the chip 10 is to be inserted, in this instance portions of strands 22 and 24. As will be pointed out hereinafter, the angularity of the tabs can be altered somewhat if necessary at the time the chip is being installed, thus making it possible for my novel chips to fit properly in fences made of different guage wire. A notch 13 bounds the lower end of tab 11 as viewed in FIG. 1, and a notch 15 bounds the upper end, whereas a notch 14 bounds the lower end of tab 12. These notches allow many different wire sizes to be accommodated. The four corners of chip 10 are denominated 17, 18, 19 and 20, as will be noted in FIG. 1. Similarly, a chip 30 has tabs 31 and 32 which extend under portions of strands 26 and 28, respectively. It is to be noted that the notches disposed alongside each tab allow the ends of the chip to better interfit with the strands of wire than otherwise would be possible. Although I have shown round notches, I am not to be so limited, for quite obviously the notches could be rectangular if desired.

A chain link fence or two is seen almost daily by the inhabitants of most civilized countries, this type of fence being made up of a number of strands of galvanized wire. Each strand contains a number of right angle bends, and in a typical path extending between the top and bottom of a fence, a given strand intertwines alternately between a similarly configured strand on its left side, and on its right side. At each intersection of one strand with another, a right angle bend of one strand is interlocked with a right angle bend of the other strand, with the result that a large number of essentially square apertures of substantially equal size are created.

In FIG. 1, strand 24, in descending from a first intersection with strand 26, moves to the left and intersects with strand 22, with a right angle bend being involved in each wire at this location. Strand 24 then moves to the right and intersects with strand 26, again with a right angle bend being involved in each wire, and with this intersection being disposed almost directly below the intersection of these two strands shown at the top of this Figure.

In accordance with conventional practice, strand 24 then moves back to the left to intersect and interlock with strand 22 again, and so forth in a regularly-recurring zig-zag pattern that brings about the creation of a large number of almost square apertures turned 45° to the horizontal, or in other words, diamond-shaped apertures with one corner of each aperture pointed up and with the diagonally opposite corner pointed down.

As revealed in FIG. 1, a portion of strand 22 is engaged by the tab 11 of chip 10, and a portion of strand 24 is engaged by tab 12 of the same chip. Although chip 10 is longer than the distance between strand 22 and strand 24 measured across the width of an aperture, because of the notches 13 and 15, and the notches 14 and 16, the chip may extend out to its full length after the tabs 11 and 12 have engaged their respective strands. This is to say, the distance between the wire-contacting portions of the tabs is almost identical to the distance between the wires defining the opposite edges of the aperture. It is quite apparent that the corners 17 and 19 reside on top of strand 22 as viewed in FIG. 1, and corners 18 and 20 reside on top of strand 24 as viewed in the same figure.

Further clarification is available from FIG. 1B, which reveals how the tab 32 of chip 30 extends under a portion of strand 28.

It is to be noted that some portions of the interwoven strands of wire 22, 24, 26 and 28 are closer to the viewer of FIG. 1 than other portions. More particularly, the portions of these strands that extend in the direction between the upper right hand corner and the lower left hand corner define a first plane, whereas the portions of these strands extending in the direction between the upper left hand corner and the lower right hand corner define a second plane spaced one-fourth to one-half inch below the first plane, as viewed in FIG. 1. It is for this reason that the chips 10 and 30 extend in the same direction, for they are to be mounted on the "near" or first plane of the chain link fence. As will be discussed hereinafter, chips forming a sign or display on the other side of the fence are turned 90° to the chips 10 and 30, so that such other chips can be appropriately mounted on strands on the other side of the fence. Note in this regard chip 8, disposed directly below the chip 10.

Although each of my novel chips could be retained in a chosen aperture in a suitable mesh by abiding by the constructional details set forth above and utilizing material that is sufficiently resilient or springy, I prefer to utilize chip construction of the type exemplified in FIGS. 2 and 3, involving a metallic construction much like that of conventional venetian blind slats. Chip 30 is constructed identically with chip 10 insofar as the placement of tabs and notches is concerned, and for convenience I have used a similar series of reference numerals in order to show correspondence of the details of chip 30 with similar components of chip 10. FIG. 3 reveals that the chip 30 is curved in the cross sectional sense, with the tab 31 being pointed toward the concave side of the chip. I will hereinafter refer to this curvature in the plane orthogonal to the length of the chip as being transverse curvature.

The occasion for this construction is that it is desired to increase the stiffness of the chip in the direction parallel to its locking end portions, or in other words, when the user grasps the chip 30 with say his right thumb in the vicinity of tab 31 and say his middle finger in the vicinity of tab 32 and then compresses or bends the chip to some extent to shorten its length, he will encounter more resistance for a given type and thickness of material because of the curvature of the chip, than he would have encountered had the chip been of planar construction.

Additionally, it is advantageous for the chip to possess curvature of the type described, in that the upper surface of the tabs 31 and 32 are caused to contact their respective strands more tightly than would have been the case had the chip been of planar construction. FIG. 1B reveals how the corner 40 is caused to reside close to the wire strand 28 as a result of the angularity or slope of the tab 32 bringing about the elimination of some of the curvature of the chip 30 by its interaction with the wire strand 28. This is to say, the length of the chip, measured between the ends of its tabs, is by design somewhat longer than the distance between the strands of the aperture in which the chip is to be inserted, so after the chip has been appropriately bent by finger pressure and then inserted in the selected aperture, the chip endeavors to return to its normal length, with the curvature of the chip in the plane orthogonal to the length of the chip providing a substantial force bringing about a return to its full length. However, I design the chip length to be such that the chip cannot return to its full "normal" length, in which its only curvature is as revealed in FIG. 3, until the tabs, such as the tabs 31 and 32 in the case of chip 30, have passed under the respective strands (26 and 28) for a considerable distance, such as revealed in FIG. 1. However, in order for this to happen, some of the transverse curvature normally possessed by the chip must be removed as a result of the interaction of the tabs with the strands which, as previously mentioned, is such as to cause the corners of the chip to be almost flat against the respective strands; see FIG. 4A.

The results of these constructional features and the interactions with the strands are such as to cause the chips to be close to the fence or other mesh in a highly advantageous manner, such that they cannot be dislodged by wind, and only can be removed by causing the chip to bend in a length-diminishing manner at a location approximately midway between its tabs, such that the distance between the tabs will decrease sufficiently to allow the tabs to pass through the space defined by the strands, such as the strands 26 and 28 in the case of chip 30 as revealed in FIG. 1.

Figure 4:
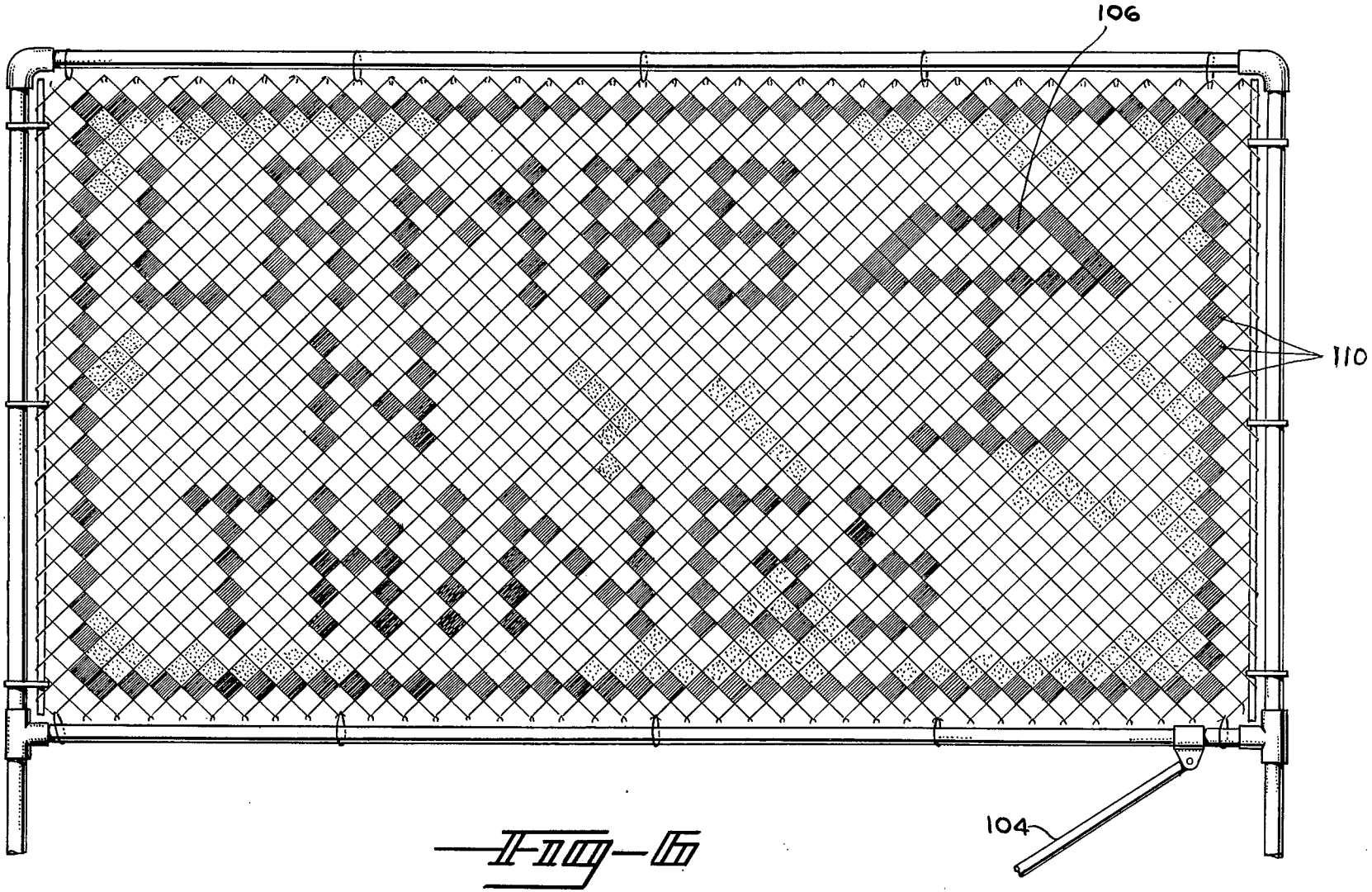
FIG. 4 is another fragmentary portion of a chain link fence, revealing one manner in which two chips on the same side of the fence can be juxtaposed.

By utilizing a plurality of chips of substantially identical construction in the creation of an intelligence bearing sign or display, it is entirely and realistically possible to have entirely different subject matter on one side of the sign than on the other. In FIG. 4 it will be noted that chip 80 is mounted on the far side of the fence with its tabs 81 and 82 under the strands of its respective aperture.

Although the chips are typically manufactured with the tabs bent in the direction of the concavity, as shown in FIG. 3, there are occasions in which it may be desirable for the person installing the tabs to reconfigure the tabs of a given chip at the time he is about to install the chip in a fence or other mesh. Such an occasion is exemplified by the instance in which a mosaic or particular type of sign is being constructed, and it is desirable to have two or more contiguous chips in a line on the same side of the mesh. Although it is possible to force chips of the same tab configuration into adjacent positions along the same line, when a chip on one side of a given strand is to share that strand with the adjacent chip, I may prefer to instruct the person endeavoring to place a chip end to end with another chip on the same side of the fence, to bend the tabs of one chip, such as the chip 70, such that its tabs 71 and 72 are above rather than below the strands of wire supporting it, thus placing its tab 71 out of possible collision with the near tab of chip 50. This of course dictates that the corners of chip 70 are inserted under the strand, or in this instance, to allow the corners of chip 50 to be on the near side of the strand, with the corners of chip 70 on the far side of the same strand, and thus out of collision with the corners of the chip 50. A further chip added alongside chip 70 would utilize the tabs in the manner furnished, with the tabs bent toward the concavity of the chip, for in this instance, there is no chip to the right of the chip 50 as viewed in FIG. 4. However, it is important to note that such reshaping of the tabs is frequently not necessary.

It should be realized with regard to chip 80 that its orientation is 90° away from the orientation of chips 50 and 70. This is because it, so to speak, is on the far side of the mesh from the side that the chips 50 and 70 are on. This explains why the tabs 81 and 82 associated with chip 80 are on the "near" side of the strands 66 and 68 as shown in this figure.

On many occasions it is desirable to have a suitable background for the chips that are used to spell out a sign or represent a display, for the back side of the chips mounted on the other side of the mesh cannot be relied upon to furnish an adequate background. When the mesh being utilized for the mounting of the chips is made up of the strands of a chain link fence, it is to be realized that the fence has a definite dimension in the thickness direction, or in other words, the portions of the strands 22 and 24 in FIG. 1 that support the chip 10 are one-fourth inch to one-half inch closer to the viewer of FIG. 1 than the portions of strands 22 and 24 that extend in the direction between the upper left hand corner and the lower right hand corner of the same figure. In view of the fact that a plurality of slots are thus inherently defined on the near side of the fence running from the lower left to the upper right, elongage members 90, 92 and 94 of considerable length may be inserted along such slots. As is obvious, by utilizing a number of parallel diagonal members of a color that is distinctive from the color of the chips to be used above such diagonal member, a pleasing, usually a contrasting background is created, thus making the chip array far more visible than it would otherwise be. Visibility can be increased even more by having the chips and elongate members covered with suitable colored plaster material, such as the Scotch-cal fluorescent sheeting material, or Scotchlite reflective sheeting material, each of these being manufactured by Minnesota Mining & Mfg. Co. The diagonal members are held in place by folding the ends over, in the manner shown in FIG. 1A.

The diagonal members are of course interior of the chips utilized on the two sides of the mesh, and as a matter of fact, I may utilize diagonal members running in two different directions, or in other words, in a cross weave, in addition to using chips on both sides of the mesh. Preferably, the diagonal strips or panel weave are inserted such that their concavity is toward the near chips, thus providing sufficient space for the tabs of the chips.

FIG. 5 illustrates a typical utilization of a plurality of chips in accordance with my invention on a signboard 100, with some twenty-eight chips being utilized to spell out the word "Pet", and some 76 of my novel chips being used to spell out the word "Supplies". As an option, a number of additional chips may be used in the creation of an eye-pleasing addition to the words. In this instance, I may create a dog 102, but a different form of character might be even more appropriate. A brace 104 may be used to add rigidity to the sign.

FIG. 6 shows the reverse side of the same sign, which is quite similar except that other chips are used, and they serve to spell out the words "Lamps N' Things". As an option, some chips may be used in the creation of a lamp 106 alongside the words. As should now be obvious, the chips on one side of the sign do not interfere with the chips used on the other side, and I may use diagonally placed background strips on one or both sides of the sign. Both sides of outer chips 110 may be colored.

It should now be apparent that I have provided a novel chip that may be manufactured and used in large quantities in the creation of highly effective, eye-catching signs. The basic new concept of course makes it possible for almost any of the millions of chain link fences presently in existence to be utilized as already established display bases. In this way, not only do I avoid the cost of maintaining a large supply of preformed letters on hand, but also I completely avoid the expense, maintenance and rental fees that are to be associated with conventional signboards.

Advantageously, I have standarized the design and configuration of my novel chip so that they may be used with a wide variety of metal meshes, and when the mesh is a chain link fence or hurricane fence, my chips may be easily and without interference utilized on both sides of the fence so as to create advertisements of perhaps dissimilar information.

It should be noted that the transverse curvature utilized in connection with the preferred embodiment my novel chip makes it possible for the chip to lock itself into the selected aperture in a mesh so that it cannot be dislodged by even high wind. This is because I place a locking tab on each end of the chip, with the distance between the wire-contacting portions of the tabs being almost identical to the distance between the wires defining opposite sides or edges of the aperture into which the chip is to be installed. For this reason, it is necessary to bend the chip in a length-decreasing manner in order to be able to install the chip, so it is therefore necessary for the chip to be bent in a like manner in order to effect its removal. In other words, when the chip has been installed in an aperture and has returned to its full, normal length, it is locked by its tabs into position, with the stiffness of the chip preventing the dislodgement of the tabs from the locking relationship.

With regard to the transverse curvature I prefer to use when the chips are of metallic construction, it is beneficial in two distinct ways. Not only does it increase the lengthwise or longitudinal stiffness of the chip so as to cause the tab to firmly engage the strands of wire, but also it causes the four corners of a rectangularly shaped chip to contact firmly the wire strands on the side opposite from the tabs. In other words, the interaction of the two corners and the tab at each end of a chip is such as to cause the elimination of some of the transverse curvature at the ends, which of course, means that each end of the chip actually clutches the wire strand with which it has contact, in a very tight manner; see FIG. 4A. It is only by the bending of the chip at a point approximately midway between its ends that enables its tabs to be removed from contact with the respective wire strands.

Figure 7:
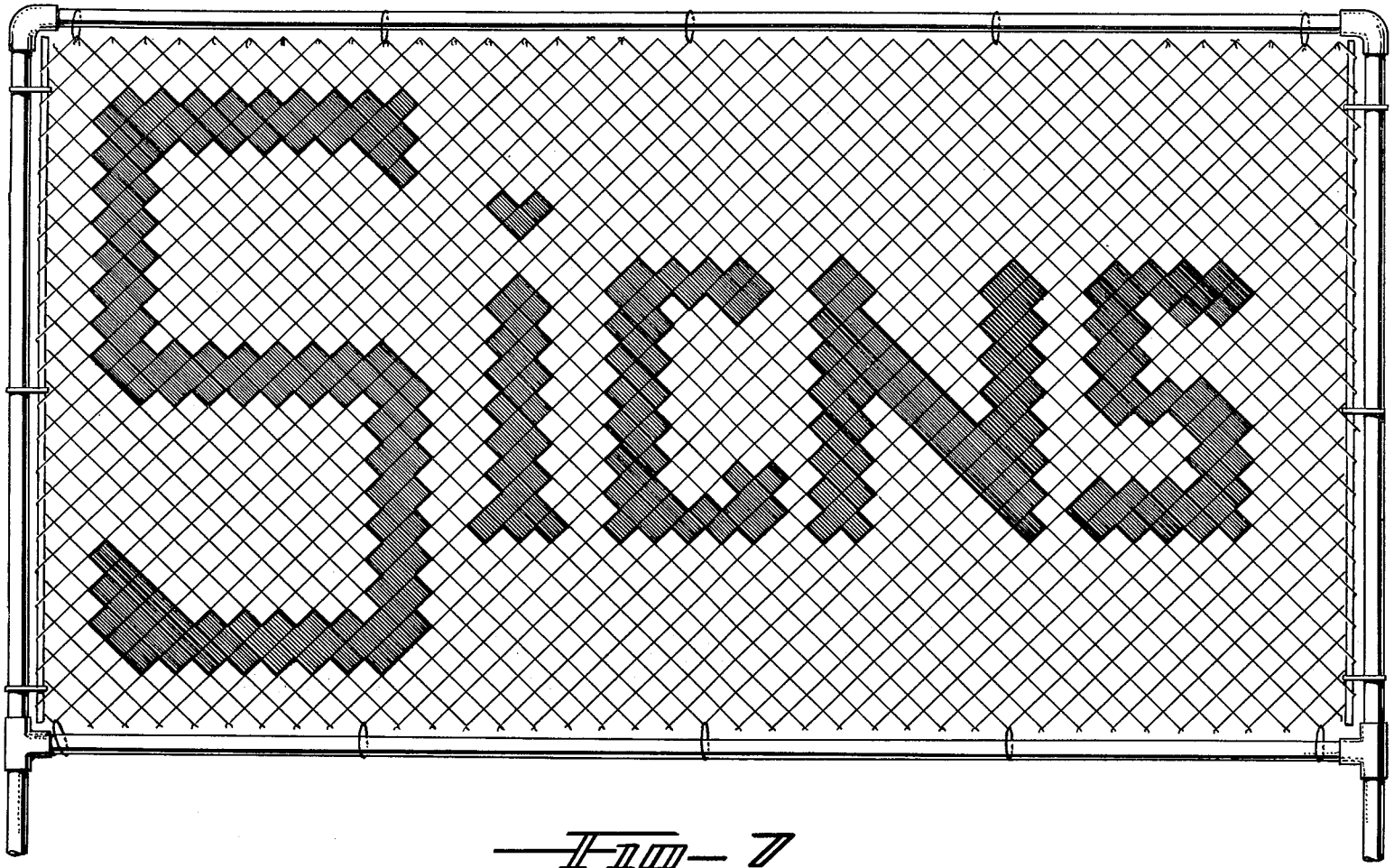
FIG. 7 illustrates how a sign constructed in accordance with this invention can be made more decorative and conspicuous by "multiple chipping ".

FIG. 7 represents a somewhat more decorative arrangement of my novel chips, used in what may be regarded as a multiple-chipping configuration, which requires more chips than does the single chip approach shown in FIG. 5, but as a result, the words so created are visible from longer distances.

Although I have principally depicted the use of chips that are of rectangular or square configuration, it is within the spirit of my invention to also use chips that do not have straight sides, or in other words, my chips may be constructed so as to be of round or elliptical configuration. Also, the chips may be hexagonal or octagonal, as long as opposite attachment edges are provided that are spaced so as to be properly received between the two sides of an aperture. If the chips are of decidedly round configuration, there may be a degree of overlap between a pair of chips residing in a side by side relation, but such overlap is disadvantageous only to a very slight extent.

Also in addition to constructing chips of curved metallic material in the nature of venetian blind slats, I can also manufacture chips of resilient materials, such as plastic, rubber, or synthetic rubber.

I claim:

1. A self-locking chip usable on a wire mesh with a number of other like chips in order to display intelligence, which mesh has numerous apertures of essentially square configuration therein to receive such chips, a given chip having a pair of oppositely disposed attachment edges configured to engage opposite sides of a given aperture in locking relationship, each attachment edge involving a tab located between a pair of corner portions, with such tab being bent out of the plane of said corner portions such that said tab can engage a different side of the contacted wire of a wire mesh than do the respective corner portions, the dimension of said chip measured between said attachment edges being slightly greater than the distance between corresponding sides of the aperture in which the chip is to be installed, said chip being of resilient material, and possessing a considerable amount of stiffness, but nevertheless being flexible enough to be able to be bent by finger pressure to an extent sufficient to materially decrease the distance between its attachment edges, said chip, when in such bent condition, being able to be inserted in a selected aperture in the mesh, and when released therein, returning to its normal length condition and becoming locked into such aperture by the interaction of said tabs and corner portions.

2. The self-locking chip as defined in claim 1 in which the chip possesses a degree of curvature in a plane that is orthogonal to a line interconnecting its oppositely disposed attachment edges.

3. The self-locking chip as defined in claim 2 in which the chip possesses considerable stiffness in the direction of the line interconnecting its attachment edges as a result of such curvature.

4. The self-locking chip as defined in claim 1 in which said tabs are bendable at the time of installation in order to take into consideration the aperture and gage of the wire mesh involved, with appropriate bending of the tabs enabling the chip to fit tightly in the selected aperture.

5. A chip as defined in claim 1 in which the chip possesses color.

6. A chip as defined in claim 1 in which the chip possesses fluorescent color.

7. A colored chip as defined in claim 1 in which the chip possesses reflective qualities.

8. A chip as defined in claim 1 in which at least one surface of the chip is covered with reflective sheeting.

9. A chip as defined in claim 1 in which at least one surface of the chip is covered with fluorescent sheeting.

10. An advertising or decorative sign for representing intelligence, comprising a plurality of strands of wire woven in interlocking relation so as to form a mesh, said mesh having numerous apertures therein of substantially square configuration and of approximately equal size; and a plurality of chips, each of approximately the size of such apertures, said chips each having a pair of oppositely disposed attachment edges adapted to engage opposite edges of a given aperture, each attachment edge involving a tab disposed between a pair of corner portions, with said tab bent out of the plane of such corner portions, the dimension of each chip measured between said oppositely disposed edges being slightly greater than the distance between corresponding edges of the aperture in which the chip is to be installed, each chip being resilient yet sufficiently flexible as to be able to be bent by finger pressure to an extent serving to decrease the distance between its opposite edges, a chip, when in such bent condition, being able to be inserted in an aperture in said mesh, or alternatively to be removable therefrom, said chip, upon being released from a bent condition, returning to its full length condition with each tab on a different side of an engaged wire of said mesh than the side upon which the corner portions reside, whereby when properly installed in an aperture in said mesh, the chip is not removable except as a result of a deliberate effort.

11. The sign as defined in claim 10 in which each of said chips is curved in cross section, with the bending of the chip by finger pressure being in a direction such as to decrease rather than to increase the curvature of the chip.

12. The sign as defined in claim 10 in which said mesh is provided with a large number of apertures, thus to enable a sufficiently large quantity of chips to be installed that a number of words can be spelled out by the selective juxtapositioning of said chips.

13. The sign as defined in claim 10 in which said tabs are deformable so that the degree of tightness of the fit of a given chip in its aperture can be controlled.

14. The sign as defined in claim 10 in which each of said chips bears a color.

15. The sign as defined in claim 14 in which both sides of a chip bear a color.

16. The sign as defined in claim 14 in which the color is fluorescent.

17. The sign as defined in claim 14 in which the color is reflective.

18. The sign as defined in claim 10 in which said strands of wire woven in interlocking relation form a chain link fence of tangible thickness, with one side of said fence being spaced from the other side, said strands defining a series of parallel slots in which can be received elongate members, said elongate members functioning to substantially occlude the portion of the fence in which they are used, thus serving as a desirable background for the intelligence created by the use of a plurality of chips placed in a desired relation.

19. A self-locking chip usable on a wire mesh with a number of other like chips in order to display intelligence, which mesh has numerous apertures of substantially square configuration therein to receive such chips, a given chip being of essentially rectangular configuration and having a pair of oppositely disposed edges configured to engage opposite sides of a given aperture in locking relationship, a tab formed at approximately a midway portion of each of said opposite edges, and bent out of the plane of the corners between which the tab is located, the longitudinal dimension of said chip measured between said opposite edges being slightly greater than the distance between corresponding sides of the aperture in which the chip is to be installed, said chip possessing curvature with respect to a plane orthogonal to the length of said chip, such curvature affording a considerable amount of stiffness to the chip, particularly in the direction of its longitudinal dimension, said chip nevertheless being flexible enough to be able to be bent by finger pressure to an extent sufficient to materially decrease the distance between its opposite edges, said chip, when in such bent condition, being able to be inserted in a selected aperture in the mesh, with the tab residing on one side of a contacted wire of the mesh, and the corners on each side of the tab being on the other side of the same wire, said chip, when released in the aperture, returning to its normal length condition and in doing so, locking itself into such aperture.

20. The chip as defined in claim 19 in which the distance between the portions of said tabs that engage the sides of the aperture is approximately the same as the distance between such sides of the aperture.

21. A sign as defined in claim 19 in which a notch is provided on each side of each tab, thus to enable the chips to be usable with wire meshes of different guages.

22. A chip as defined in claim 19 in which each of said chips bears a color.

23. The chip as defined in claim 19 in which the mesh in which chips are placed is provided with a large number of apertures, thus to enable a sufficiently large quantity of chips to be used that a number of words can be spelled out by the selective juxtapositioning of chips.

24. The chip as defined in claim 19 in which the strands of wire woven in interlocking relation form a chain link fence of tangible thickness, with one side of the fence being spaced from the other side, the strands of wire defining a series of parallel slots in which can be received elongate members, said elongate members functioning to substantially occlude the portion of the fence in which they are used, thus serving as a desirable background for the intelligence created by the use of a plurality of chips placed in a desired relation.

* * * * *